United States Patent [19]

Urwyler

[11] Patent Number: 4,638,696

[45] Date of Patent: Jan. 27, 1987

[54] APPARATUS FOR DISPENSING STRIP MATERIAL OR THE LIKE

[75] Inventor: Peter R. Urwyler, Modesto, Calif.

[73] Assignee: Simtek Inc., Modesto, Calif.

[21] Appl. No.: 651,263

[22] Filed: Sep. 17, 1984

[51] Int. Cl.[4] ..... B65H 75/00; B26D 5/22

[52] U.S. Cl. ..... 83/261; 83/566; 83/649

[58] Field of Search ..... 83/205, 223, 224, 259, 83/261, 566, 568, 570, 586, 587, 649, 650, 449; 225/46, 47; 242/55.53, 56 R, 71.7

[56] References Cited

U.S. PATENT DOCUMENTS

| | | | |
|---|---|---|---|
| 2,579,149 | 12/1951 | Krueger et al. | 225/46 |
| 2,959,998 | 11/1960 | Etzenhouser | 83/369 |
| 3,072,000 | 1/1963 | Bracey et al. | 83/568 X |
| 3,144,184 | 8/1964 | Yerkes | 225/47 X |
| 3,177,750 | 4/1965 | Amemiya | 83/261 X |
| 3,237,595 | 3/1966 | Kilham | 118/42 |
| 3,283,631 | 11/1966 | Strom | 83/211 |
| 3,465,629 | 9/1969 | Krueger | 83/205 |
| 3,798,108 | 3/1974 | Ioannilli | 83/566 X |
| 3,802,309 | 4/1974 | Bosland | 83/176 |
| 4,325,277 | 4/1982 | Uchida et al. | 83/205 X |
| 4,455,905 | 6/1984 | Raymond | 83/649 |
| 4,513,647 | 4/1985 | Eckalt et al. | 83/261 X |

*Primary Examiner*—James M. Meister

*Attorney, Agent, or Firm*—Worrel & Worrel

[57] ABSTRACT

An apparatus for dispensing strip material or the like from a source of said material, the apparatus having a frame; a mount borne by the frame for receiving a source of the material; a drive member mounted on the frame for feeding a strip of the material from the source of the material; and a control member mounted on the frame for movement toward and from the drive member and selectively positionable to carry a strip to the material extended between the control member and drive member into engagement with the drive member selectively to feed the strip of material from the source of the material.

7 Claims, 6 Drawing Figures

APPARATUS FOR DISPENSING STRIP MATERIAL OR THE LIKE

BACKGROUND OF THE INVENTION

1. Field of the Invention

The present invention relates to an apparatus for dispensing strip material or the like and more particularly to such an apparatus which is unusually well suited to the dispensing of strip material such as adhesive tape from a roll of such material in selectively determinable lengths and without having physically to contact the strips during the dispensing operation.

2. Description of the Prior Art

There are a variety of materials which must be dispensed from continuous sources of the material on a frequent basis where the length of the material to be dispensed may vary substantially from one instance to the next. For example, such materials as ribbon, string, wire, postage stamps and a wide assortment of other materials are commonly dispensed from rolls of such material. Prior art devices designed for such dispensing operations have suffered from several chronic problems which have prevented their being accepted for common usage. A lack of dependability as the result of jamming of the operative mechanisms have been a primary impediment.

These problems are compounded in devices particularly adapted to the dispensing of adhesive material such as adhesive tape. Whether the particular form of tape is cloth type electrician's tape, opaque plastic electrician's tape, masking tape, reinforced wrapping tape, paper tape, clear plastic tape, surgical tape, or any of a host of other types of adhesive tapes commonly used, jamming of the operative mechanism of prior art dispensing devices has been almost certain due to contact of adhesive surfaces with the operative mechanism of the dispensing devices. In such prior art devices, the adhesive material borne by the tape is simply transferred over time to the surfaces within which it comes in contact and that transferred adhesive interferes with working parts of the device. Further, the transferred adhesive may adhere to otherwise nonadhesive portions of the tape so that the tape itself becomes fouled.

Still another chronic difficulty encountered in prior art dispensing devices, whether for dispensing adhesive tape or other type materials, is the propensity for slack to form in the lead portion of the material within the device which may become entangled in the operative mechanism thereby jamming the device.

Therefore, it has long been known that it would be desirable to have an apparatus for dispensing strip material from a source of said material which operates dependably, rapidly, and in such a way as to permit the operator selectively to determine the length of the strip of material to be dispensed and which, while possessing these capabilities, operates in such a manner as virtually to preclude jamming of its operative components.

OBJECTS AND SUMMARY OF THE INVENTION

Therefore, it is an object of the present invention to provide an improved apparatus for dispensing strip material or the like.

Another object is to provide such an apparatus which is particularly well suited to the dispensing of a variety of ribbon or strip material from a continuous roll of such material and which is particularly adapted for the dispensing of adhesive tapes such as transparent plastic adhesive tape.

Another object is to provide such an apparatus which is operable to dispense adhesive tape rapidly and dependably in portions of selected lengths while reducing to an absolute minimum the possibility of becoming jammed.

Another object is to provide such an apparatus which cooperates with the natural properties of adhesives borne by adhesive tape to handle the dispensing of such adhesive tape from the roll in such a manner virtually to preclude jamming.

Another object is to provide such an apparatus which is operable to sever precisely defined selected portions of adhesive tape in accordance with the needs of the operator without requiring any contact between the operator and the adhesive tape until after such severing is achieved and which uses the natural adhesive properties of the adhesive tape to hold the segment so severed in position for grasping by the operator.

Another object is to provide such an apparatus which can easily be loaded with a source of the material to be dispensed without requiring any complicated feeding of the lead portion of the strip material into the dispensing mechanism.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
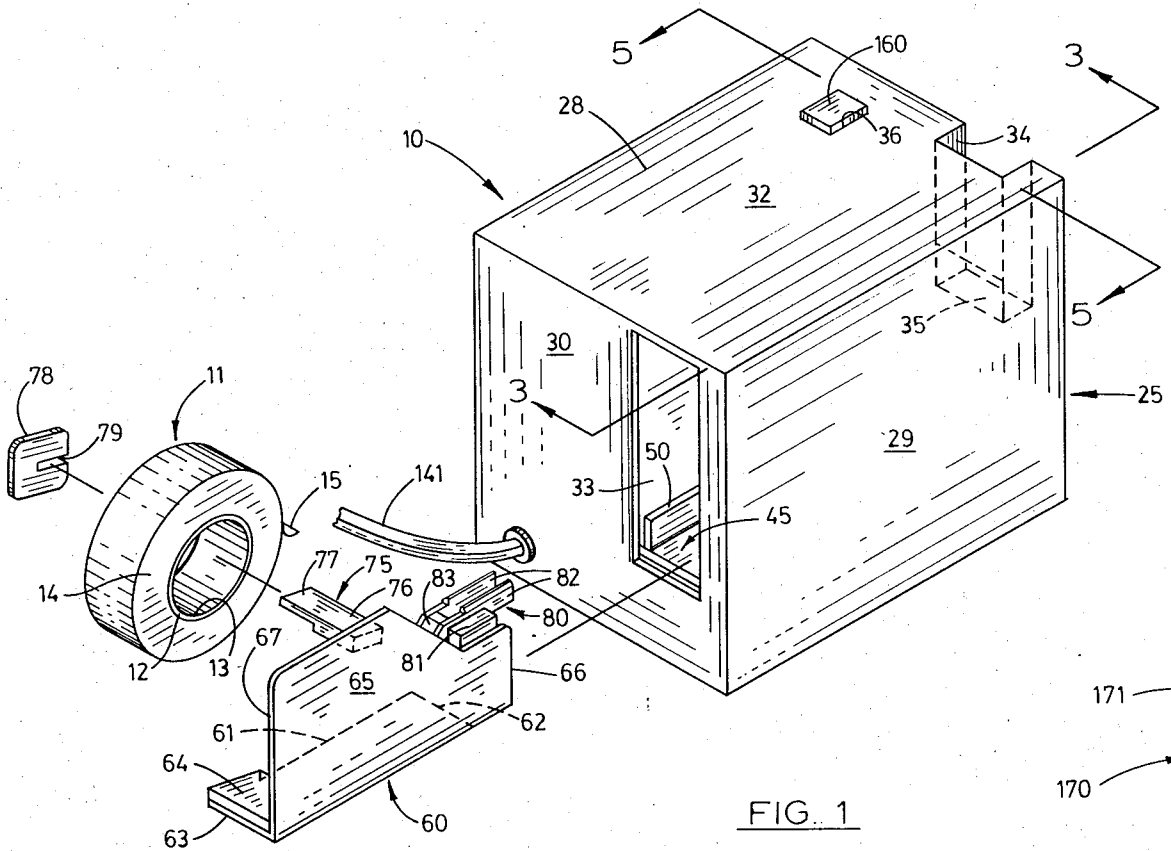
FIG. 1 is a fragmentary perspective view of the apparatus of the present invention shown with the cartridge removed for purposes of illustrative convenience and disposed to receive a roll of adhesive tape.

Referring more particularly to the drawings, the apparatus for dispensing strip material or the like of the present invention is generally indicated by numeral 10 in Fig. 1.

As will become more clearly apparent, the apparatus 10 is adapted to dispense strip material or the like from a source of such material and is particularly well suited to the dispensing of adhesive tape from a roll of adhesive tape. For illustrating the operation of the apparatus, a conventional roll of adhesive tape is generally indicated by the numeral 11 in FIG. 1. In order more clearly to understand the operation of the apparatus when dispensing tape from such a roll, it will be understood that the adhesive tape of the roll is of the transparent or semitransparent, plastic type having a single adhesive surface. The roll has a cylindrical core 12 containing a cylindrical opening 13 substantially concentric to the cylindrical core. Adhesive tape 14 is concentrically wound about the core in the conventional manner to form the roll. During use, a lead portion 15 is pulled from the roll as the tape is used. The tape has an adhesive surface 16 and an opposite, nonadhesive surface 17.

While the apparatus 10 is described herein for dispensing tape from the roll 11, it will be understood that the apparatus can be employed to dispense a variety of types of strip material and the like and the invention hereof is not limited to dispensing adhesive tape.

The apparatus 10 has a box-like frame or housing 25 best shown in FIG. 1. The housing has a substantially flat floor 26 on which are mounted four rests 27 in positions for supporting the floor on a supporting surface, not shown. The housing has a cover 28 composed of a pair of spaced side walls 29, a rear wall 30, a front wall 31 and a top wall 32. The walls forming the cover are preferably of unitary construction forming a substantially box-like configuration. A substantially rectangular insertion opening 33 is provided in and extends through the rear wall 30 of the cover. A recess 34 is formed in the front wall of the cover and communicates with a smaller dispensing opening 35. A rectangular opening 36 is provided in the top wall 32. The precise size, configuration and position of the openings 33, 35 and 36 are preferably those best shown in FIG. 1.

A cartridge platform 45 is mounted on the floor 26 of the housing 25 in alignment with and between the insertion and dispensing openings 33 and 35. The cartridge platform includes an outer support 46 mounted in upstanding relation on the floor immediately adjacent to the side wall 29 of the cover 28 as can best be seen in FIG. 6. An inner support 47 is mounted on the floor in upstanding relation and spaced relation to the outer support 46. A floor 48 is mounted on the upper ends of the outer and inner supports in substantially parallel relation to the floor 26 of the housing and extending from a position immediately adjacent to the insertion opening 33 to a position spaced from the front wall 31 of the cover a distance below the dispensing opening 35, as can best be seen in FIGS. 3 and 4.

The floor 48 of the cartridge platform 45 has an upper surface 49 on which are mounted a pair of guide rails 50 in spaced substantially parallel relation to each other and to the longitudinal axis of the floor 48. A stop 51 is mounted on the upper surface 49 of the floor 48 on the right as viewed in Figs. 3 and 4 and has a lip 52 mounted thereon and extending in the direction of the insertion opening in spaced relation to the upper surface 49 of the floor 48.

A cartridge 60 is dimensioned to be received in the insertion opening 33 and slidably moved within the housing 25 along the cartridge platform 45. The cartridge has a base plate 61 having a leading edge 62 and an opposite trailing edge 63. A grasping surface 64 is formed on the base plate immediately adjacent to the trailing edge of the base plate, as can best be seen in FIG. 1. The cartridge has a main wall 65 mounted on the base plate in substantially right angular relation thereto and having a leading edge 66 spaced to the right, as viewed in FIGS. 1, 3 and 4 from the leading edge 62 of the base plate 61. The main wall has a trailing edge 67 which is disposed in substantially the same plane as the trailing edge 63 of the base plate. As can best be visualized in FIGS. 3 and 4, the base plate has a thickness such as to allow it slidably to be received between the upper surface 49 of the floor 48 of the cartridge platform 45 and the lip 52 thereof. Thus, when the cartridge is moved to the fully installed position shown in FIGS. 3 and 4, hereinafter referred to as the loaded position, the leading edge 62 of the base plate 61 abuts the stop 51 of the cartridge platform and is captured beneath the lip 52 thereof.

A mounting assembly 75 is mounted on the main wall 65 of the cartridge 60 in spaced relation to the base plate 61. The mounting assembly includes a support 76 which is affixed on the main wall extending outwardly therefrom preferably at the slight angle with respect to horizontal, as viewed in FIGS. 3 and 4, and having a substantially flat, thin remote portion 77. The mounting assembly further includes a clip 78 having a notch or passage 79 adapted to be slidably received in releasably locking relation on the remote portion 77.

The cartridge 60 also has a feeding assembly 80 mounted on the main wall 65 adjacent to the leading edge 66 thereof in spaced relation to the base plate 61, as can best be seen in FIGS. 1, 3, 4 and 6. The feeding assembly includes a mount 81 secured on the main wall in spaced relation to the leading edge 62 of the base plate. A pair of guides or guide rails 82, the rails of the pair thereof separated from each other in spaced substantially parallel relation by a spacer 83, are affixed on the mount 81 in spaced relation to the main wall and extending to the right of the leading edge 66 of the main wall 65, as viewed in FIGS. 3 and 4. The guide rails have tapered upper edges 84, as can best be seen in FIG. 6.

Figure 5:
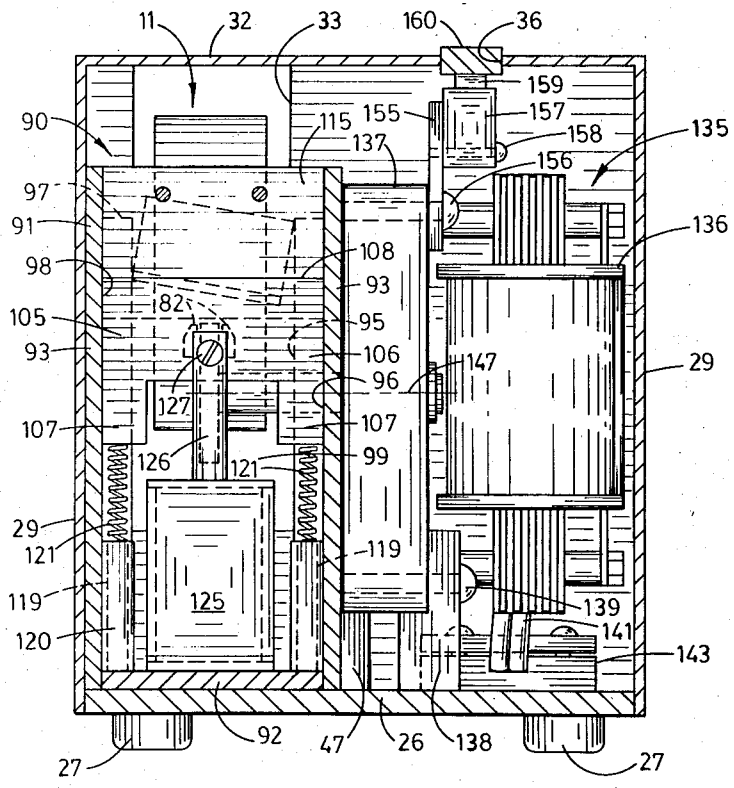
FIG. 5 is a somewhat enlarged transverse vertical section taken on line 5—5 in FIG. 1 and showing the control mechanism of the apparatus in a severing mode.

A control mechanism 90 is mounted on the floor 26 of the housing 25 on the left, as viewed in FIG. 5. The control mechanism has a main frame 91 including a base plate 92 mounted on the floor 26 and a pair of side plates 93 individually mounted on opposite ends of the base plate and extending upwardly therefrom in spaced substantially parallel relation to each other and in substantially right angular relation to the base plate. The side plate 93 on the left as viewed in FIG. 5 is placed preferably in facing engagement with the side wall 29 of the housing on the left as viewed in FIG. 5. A cross member 94 is affixed on and interconnects the remote ends of the side plates extending substantially parallel to the base plate 92. As can best be visualized upon reference to FIGS. 3, 4 and 5, the main frame is positioned adjacent to the dispensing opening 35 of the front wall 31 of the cover 28 with the side plates 93 disposed on opposite sides and rearwardly from the dispensing opening 35.

A first pair of guide rails 95 are mounted on the side plate 93 of the main frame 91 on the right as viewed in FIG. 5 in spaced substantially parallel relation to each other extending between the base plate 92 and the cross member 94 of the main frame and defining a first guide track 96 therebetween. A second pair of guide rails are mounted on the side plate 93 on the left as viewed in FIG. 5 in spaced substantially parallel relation to each other extending between the base plate 92 and the cross member 94 to define a second guide track 98. The guide tracks 96 and 98 are disposed substantially in the same plane and are substantially parallel to each other to define a path of travel 99 along and between the tracks from the base plate 92 to the cross member 94.

The control mechanism 90 has a control member or frame 105 mounted therein for movement along the path of travel 99. The control frame has a second tape contact portion, release or mounting plate 106 having leg portions 107 and dimensioned for fitted slidable receipt in the guide tracks 96 and 98 for movement of the mounting plate along the path of travel 99. The mounting plate has an upper surface 108 which is preferably substantially flat and normal to the guide tracks. A slot 109 is formed in the upper surface 108 extending longitudinally thereof, as can best be seen in FIGS. 3 and 4.

A pair of side plates 110 are mounted on the mounting plate 106 in spaced substantially parallel relation to each other and substantially right angularly related to the upper surface 108 of the mounting plate. The side plates are positioned individually just inwardly of their respective adjacent first and second pair of guide rails 95 and 97 respectively and extend in the direction of the insertion opening 33 of the rear wall 30. A cross plate 111 is mounted on and interconnects the side plates at the corresponding ends thereof upwardly of the slot 109 of the mounting plate as can best be seen in FIGS. 3 and 4. A first tape contact portion or feed plate 112 is mounted on the cross plate and extends at the oblique angle shown in FIGS. 3 and 4 in the general direction of the insertion opening 33 of the rear wall of the cover 28. The feed plate 112 has a lower contact surface 113 having a remote beveled edge 114.

A blade mount 115 is affixed on the cross member 94 of the main frame 91 by a pair of screws 116 extending through the cross member and screw threadably secured in the blade mount 115. A severing blade 117 is mounted on the blade mount substantially centrally positioned in the main frame within the path of travel 99 for receipt in the slot 109 of the mounting plate 106 when the mounting plate is moved to the fully upwardly extended position shown in FIG. 3 hereinafter referred to as the severing position. The blade has a cutting edge 118 which is disposed at an oblique angle, as can best be seen in phantom lines in FIG. 5, for purposes of enhancing the severing ability thereof.

A pair of compression spring assemblies 119 are individually mounted on the base plate 92 of the main frame 91 individually within the guide tracks 96 and 98, as can best be seen in FIG. 5. Each of the spring assemblies has a mount 120 which is secured on the base plate 92 within its respective guide track and a compression spring 121 which interconnects the mount 120 and the leg portion 107 of the mounting plate 106 within its respective guide track. As will hereinafter be described in greater detail, the compression spring assemblies 119 maintain the control frame 105 and more particularly the mounting plate 106 thereof in an extended or severing position shown in FIG. 3. The control frame is, however, positionable in a retracted, driving or feeding position within the path of travel 99, shown in FIG. 4, wherein the blade 117 is spaced from the slot 109 and upper surface 108 of the mounting plate.

An electric solenoid 125 is mounted on the base plate 92 of the main frame 91 between the first and second pair of guide rails 95 and 97 respectively. The electric solenoid has a solenoid arm 126 movable toward and from the solenoid in the conventional manner having a remote end portion mounted on the mounting plate 106 by a screw 127. Thus, it will be seen that actuation of the electric solenoid causes the solenoid arm 126 to be retracted into the solenoid so as to move the mounting plate 106 to the retracted, feeding position shown in FIG. 4 against the action of the compression spring assemblies 119.

The apparatus 10 has a drive motor assembly or drive system 135 consisting of an electric motor 136 mounted in driving relation to a transmission 137. As shown and described herein, the electric motor and transmission are of unitary construction and conventional design. Any suitable electric motor and transmission can be employed in the apparatus. A drive system mount 138 is affixed in upstanding relation on the floor 26 of the housing 25 in spaced relation to the side plate 93 on the right as viewed in FIG. 5. The drive system is secured on the mount 138 by a mounting screw 139 extending through the mount 138 and into the transmission 137, as best shown in FIG. 5. The drive system is also mounted on the inner support 47 of the cartridge platform 45 by a mounting screw 140 extended through the inner support and into the transmission The electric motor 136 has a conventional electric cord 141 having an electric plug 142 at the remote end thereof for insertion in a source of electrical energy such as a wall outlet not shown. The cord is extended through the rear wall 30 of the cover 28, as can best be seen in FIG. 1. A cord retaining assembly 143 is mounted on the floor 26 of the housing with the electriccord 141 extended therethrough for purposes of retaining the cord in position within the housing 25.

The transmission 137 has a drive shaft 145 operably extended therefrom and having a remote end portion 146 positioned above the upper surface 49 of the floor 48 of the cartridge platform 45 for rotation about an axis of rotation 147 substantially parallel to the upper surface 49. A drive wheel 148, having a peripheral surface 149, is mounted on the remote end portion 146 of the drive shaft for rotation about the axis of rotation 147 and in a predetermined position such that when the cartridge 60 is disposed in the loaded position shown in FIGS. 3, 4, 5 and 6, the wheel is positioned between the guide rails 82 with the peripheral surface 149 thereof being slightly above the tapered upper edges 84 of the guide rails. This relationship can best be seen in FIG. 6.

A switch mount 155 is fastened on the transmission 137 by a screw 156 extended through the switch mount and into the transmission. An electric control switch 157 is secured on the switch mount by a screw 158 extended through the electric control switch and into the switch mount. The electric control switch has a switch button 159 depressable to close the switch. The plunger 160 is dimensioned for slidable receipt within the rectangular opening 36 of the top wall 32 of the cover 28 in rested engagement with the switch button 159. Thus it will be seen that depression of the switch plunger 160 closes the electric control switch 157 by depression of the switch button 159 therebetween.

Figure 2:
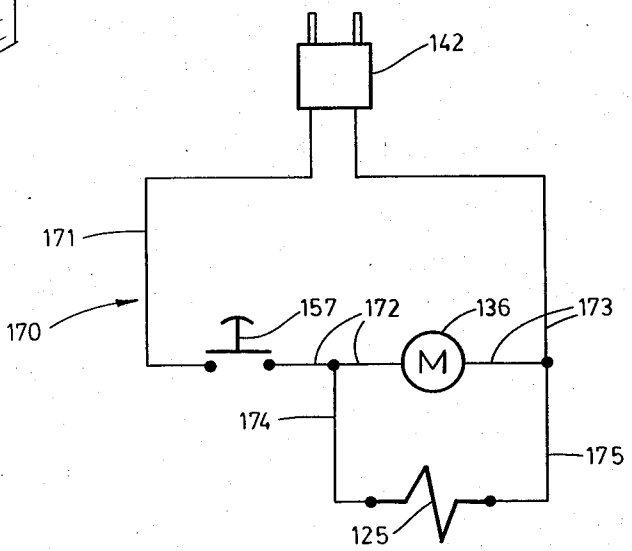
FIG. 2 is a schematic diagram of the electrical system of the apparatus of the present invention.

The apparatus 10 has an electrical system 170 shown diagrammatically in FIG. 2. The electrical system includes an electrical conductor 171 operatively interconnecting the electric plug 142 and the electric control switch 157. An electrical conductor 172 operatively interconnects electric control switch 157 and the electric motor 136. An electrical conductor 173 operatively interconnects the electric motor and the electric plug 142. Electrical conductors 171 and 173, of course, extend through electric cord 141 to the electric plug for purposes of connection to a source of electric energy such as an electric outlet. An electrical conductor 174 operatively interconnects electrical conductor 172 and the electric solenoid 125. Electrical conductor 175 operatively interconnects the electric solenoid 125 and the electrical conductor 173.

OPERATION

The operation of the described embodiment of the subject invention is believed to be readily apparent and is briefly summarized at this point. The apparatus 10 is loaded by removing the cartridge 60 from the housing 25 from the insertion opening 33. The cartridge is itself loaded by removing the clip 78 from the support 76 and positioning a roll of adhesive tape 11 thereon, as may be visualized in FIG. 1, with the support 76 extending through the cylindrical opening 13 of the cylindrical core 12 thereof. The roll is locked in position by sliding the clip into position so that the remote portion 77 of the support is received in the notch 79 of the clip. Such mounting of the roll of adhesive tape supports the roll for rotational movement about the support 76 as well as allowing a swinging or pivoting movement of the roll of adhesive tape about the support. Such movement may be visualized upon reference to FIGS. 3 and 4 in that the range of such swinging movement accommodates such movement of the roll of adhesive tape from what may be viewed as a fully gravitationally suspended position shown in FIG. 3 to a forwardly pivoted position shown in FIG. 4.

Once the roll of adhesive tape 11 has been installed on the mounting assembly 75 of the cartridge 60 as described, the lead portion 15 of tape is drawn from the roll and positioned in rested adhesive engagement on the tapered upper edges 84 of the guide rails 82. The cartridge 60 is then inserted through the insertion opening 33 of the rear wall 30 and moved to the fully loaded position shown in FIGS. 3 and 4. Engagement of the leading edge 62 of the base plate 61 with the stop 51 indicates to the operator when the loaded position has been reached. This causes the guide rails to move on opposite sides of the drive wheel 148 and thus the lead portion 15 of the adhesive tape to be passed over the peripheral surface 149 of the drive wheel therebetween. The lead portion of adhesive tape is thus disposed in the position shown in FIG. 6. At this same time however, the control mechanism 90 is disposed in the extended or severing position shown in FIG. 3 so that the feed plate 112 is not in engagement with the peripheral surface 149 of the drive wheel 148 or the lead portion 15 of adhesive tape extended over the peripheral surface 149.

Figure 3:
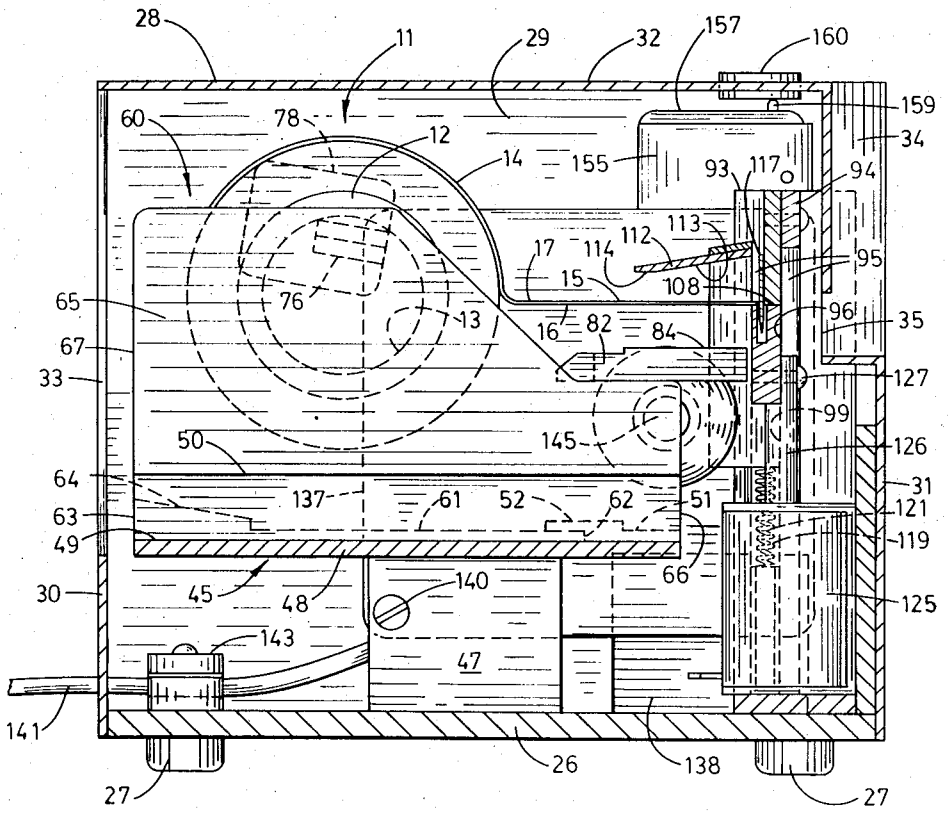
FIG. 3 is a somewhat enlarged fragmentary longitudinal vertical section taken on line 3—3 in FIG. 1 and showing the control mechanism of the apparatus in a severing mode.
Figure 4:
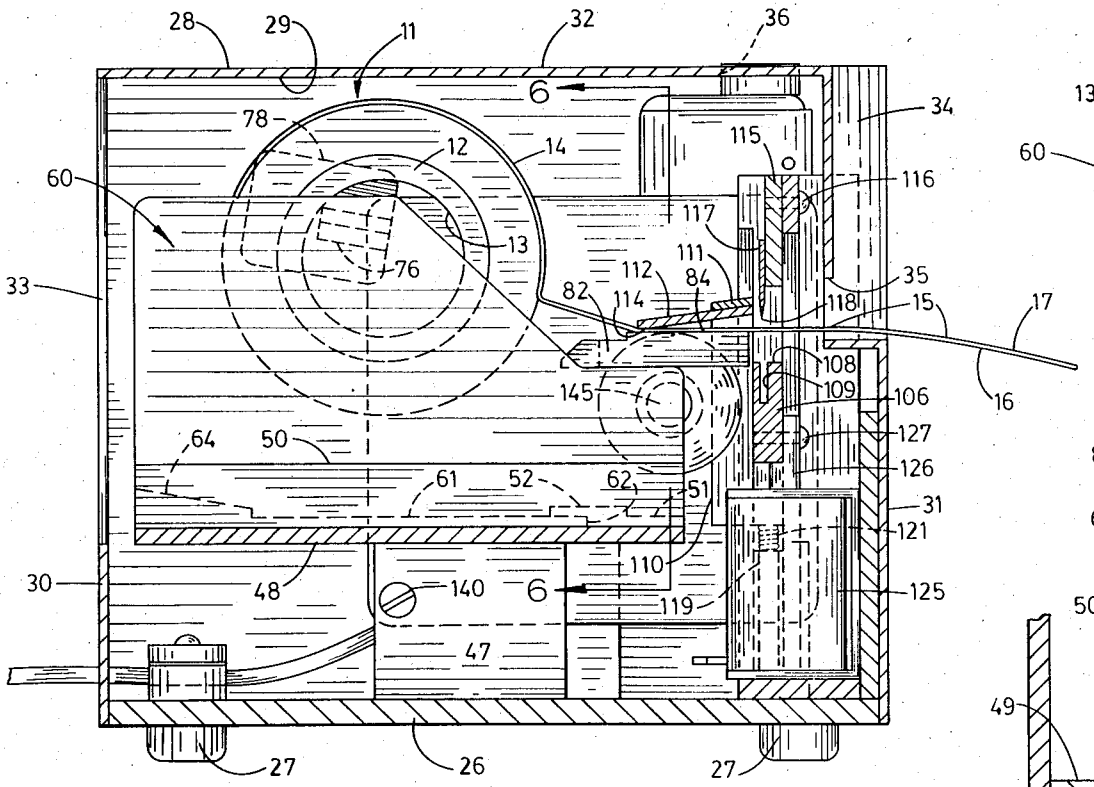
FIG. 4 is a somewhat enlarged fragmentary longitudinal vertical section taken from the same position indicated by line 3—3 in FIG. 1, but showing the control mechanism of the apparatus in a feeding mode.

The apparatus 10 is then connected to a suitable source of electrical energy, not shown, by connection of the electric plug 142 to the source. When so connected, the apparatus 10 is operable at any time for the dispensing of adhesive tape 14 from the roll 11. Such dispensing is accomplished simply by depressing the switch plunger 160 to actuate the electric control switch 157 as heretofore described. This action simultaneously causes the drive motor assembly 135 to rotate the drive wheel 148 in a clockwise direction as viewed in FIGS. 3 and 4 and the electric solenoid 125 to move the control frame 105 to the retracted or feeding position shown in FIG. 4. The contact surface 113 of the feed plate 112 presses the lead portion into tangential engagement with the peripheral surface 149 of the drive wheel 148, the lead portion thus being disposed in a feeding station substantially tangentially related to the drive wheel. The peripheral surface of the drive wheel, contacting the adhesive surface 16 of the lead portion 15 of the tape, reels the lead portion between the blade 117 and the mounting plate 106 and from the housing through the dispensing opening 35. Such dispensing of tape continues for as long as the switch plunger 160 remains depressed. As can be seen in FIG. 4, the pulling effect of the drive wheel upon the lead portion of the tape 15 not only continues to pull the tape from the roll, but also pivots the roll of tape in the direction of the dispensing opening.

When the desired length of adhesive tape 14 has been dispensed, the operator simply releases the switch plunger 160. This opens the electric switch 157 and immediately terminates the flow of electrical current through the electrical system 170 thereby immediately deactivating the drive motor assembly 135 and the electric solenoid 125. Such deactivation immediately stops rotation of the drive wheel 148 and allows the compression spring assemblies 119 to return the control frame 105 to the extended or severing position shown in FIG. 3. As the mounting plate is moved toward the cutting edge 118 and the cutting edge passes into the slot 109, the cutting edge severs the adhesive tape in the length desired, such position of the mounting plate constituting a severing station. The action of the mounting plate 106 moving to the severing position also accomplishes another function in that the lead portion 15 of adhesive tape is drawn from the upper edges 84 of the guide rails 82 and from the peripheral surface 149 of the drive wheel 148 therebetween due to the adhesive force of the lead portion on the upper surface 108 of the mounting plate 106. Once severing has occurred, only the very tip of the lead portion 14 remains adhesively attached to the upper surface 108, as can be seen in FIG. 3. However, the removal of the tape from the upper edges of the guide rails and from the peripheral surface of the drive wheel therebetween is accomplished before such severing and therefore only the minimal adhesive retention afforded by the tip of the lead portion is sufficient to retain the new lead portion 15 so formed out of engagement with the upper edges 84 of the guide rails 82 and the peripheral surface of the drive wheel.

Still another function is performed by movement of the control frame 105 to the severing position in that the slack in the new lead portion 15 of adhesive tape 14 formed between the mounting plate and the roll is taken up by the gravitational swinging of the roll 11 of adhesive tape back to the fully gravitationally suspended position shown in FIG. 3. This action operates to avoid jamming of the device in that such slack is taken up as well as arranging the roll and lead portion in the optimum position for immediate dispensing of a new strip of adhesive tape.

Figure 6:
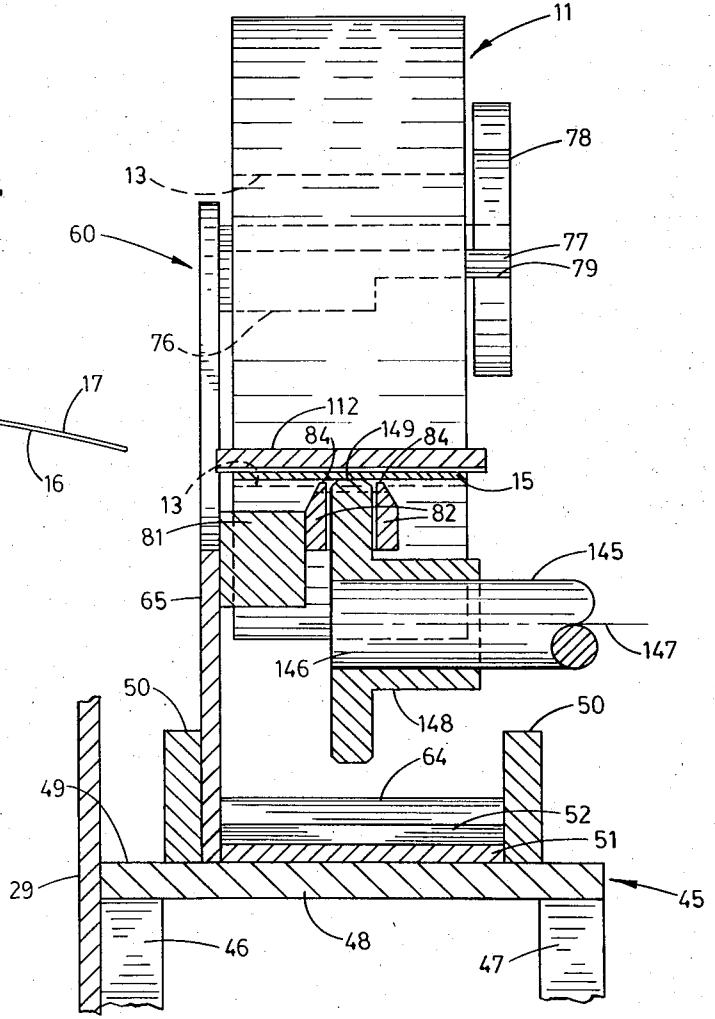
FIG. 6 is a somewhat further enlarged fragmentary transverse vertical section taken from a position indicated by line 6—6 in FIG. 4 and showing the control mechanism in the feeding mode.

After the initial cycle just described, reoperation of the apparatus 10 can be performed immediately. Upon depression of the switch plunger 160, the drive motor assembly 135 and electric solenoid 125 are again simultaneously operated. The feed plate 112 is immediately drawn downwardly against the nonadhesive surface 17 of the lead portion 15 to draw the lead portion from adhesive retention of the tip thereof on the upper surface 108 of the mounting plate 106 and into contact with the upper edges 84 of the guide rails 82 and the peripheral surface 149 of the drive wheel 148. This relationship is shown in FIG. 6. Operation of the apparatus thereafter is as heretofore described.

Therefore, it will be seen that the apparatus for dispensing strip material and the like of the present invention operates to provide a fully dependable and practical means for dispensing strip material and the like, including adhesive tape, rapidly, in lengths precisely as desired, while minimizing the possibility of jamming in an apparatus which is both of sturdy and dependable construction as well as being inexpensive.

Although the invention has been herein shown and described in what is conceived to be the most practical and preferred embodiment, it is recognized that departures may be made therefrom within the scope of the invention, which is not to be limited to the illustrative details disclosed.

Having thus described my invention, what I claim as new and desire to secure by Letters Patent is:

1. An apparatus for dispensing adhesive tape from a roll of adhesive tape, the apparatus comprising a housing; feeding means mounted on the housing having a drive wheel adapted for substantially rotational movement substantially in a first plane to define a feeding station substantially tangential to the feeding means; means for supporting a roll of said adhesive tape in feeding relation to the feeding means with a lead portion of said adhesive tape in the feeding station, said supporting means being a cartridge adapted to receive one of said rolls of tape and to be inserted within the housing in communication with the feeding station in a loaded position having a pair of spaced substantially parallel guides mounted thereon so that the guides of said pair of guides are, when the cartridge is in the loaded position, disposed on opposite sides of the drive wheel so as with the periphery of the drive wheel therebetween to define a second plane substantially right-angularly related to said first plane and, when the cartridge supporting one of said rolls is moved to the loaded position within the housing, the guides are to be engaged by an adhesive side of said lead portion of the tape to carry said lead portion into the feeding station in overlaying relation to the drive wheel; a control mechanism mounted on the housing in substantial alignment with the feeding station and having first and second tape contract portions fixed in spaced relation relative to each other, and for movement relative to the feeding station along a path substantially transversely thereof between a feeding position, wherein the first tape contact portion substantially overlays the feeding means in the feeding station, and a severing position, wherein the first tape contact portion is spaced from the feeding station and the second tape contact portion is in a severing station; a severing blade mounted on the housing in the severing station for engagement by the seoncd tape contact portion; and power means operable in a first mode to rotate the feeding means and substantially simultaneously to move the first and second tape contact portions to the feeding position and thus said lead portion of the tape into engagement with the feeding means to feed the lead portion in substantially continuous movement from the roll of adhesive tape and between the second tape contact portion and the severing means, and in a second mode to move the first and second contact portions to the severing position pulling the lead portion of the roll of tape from the feeding means to discontinue said feeding and severing said lead portion against the severing blade in the severing station.

2. An apparatus for dispensing adhesive tape from a roll of adhesive tape having a continuous strip of said adhesive tape wound substantially concentrically about itself and adapted to be dispensed by pulling on an outer end of said strip to unwind a lead portion of the length desired from said roll, the apparatus comprising:

A. a housing having a tape insertion opening on one side thereof and a tape dispensing opening in substantial alignment therewith on the other side thereof;

B. a main frame mounted on and within the housing having a pair of spaced substantially parallel guide tracks facing each other to define a path of travel adjacent to the tape dispensing opening within the housing;

C. a drive motor assembly mounted on the housing adjacent to the main frame;

D. a drive wheel borne by the drive motor assembly for driven rotational movement by the drive motor assembly about an axis in juxtaposition to the path defined by the guide tracks of the main frame and substantially parallel thereto;

E. a control frame mounted on the guide tracks of the main frame for movement along said path between a driving position and a severing position, said control frame having:

(1) a feed plate extended therefrom so as to overlay the drive wheel when the control frame is in the driving position and to be spaced therefrom when the control frame is in the severing position, and (2) a release plate borne by the control frame so as to extend substantially between the guide tracks for movement with the control frame along said path;

F. an electric solenoid mounted on the housing, connected to the control frame and operable to move the control frame along said path;

G. a severing blade mounted on the main frame in position for engagement by the release plate in severing relation to a strip of said adhesive tape when the control frame is in the severing position;

H. a cartridge adapted to mount a roll of said adhesive tape dimensioned for insertion through the insertion opening in the housing and to a loaded position and having a pair of guides borne thereby, the guides of the pair of guides disposed in spaced substantially parallel relation to each other so as to be adjacent to and on opposite sides of the drive wheel when said cartridge is in the loaded position so as with the periphery of said drive wheel to define a feeding station and engagable by the lead portion of said strip of adhesive tape to carry said lead portion into the feeding station upon insertion of the cartridge into the loaded position; and I. an electrical system operably connected to the drive motor assembly and electric solenoid and selectively operable to energize the drive motor assembly to rotate said drive wheel and energize the electric solenoid to move the control frame to the driving position to feed said lead portion between the release plate and severing blade and from the housing through the dispensing opening and upon deenergizing the electric solenoid to return the control frame to the severing position causing the release plate to pull said lead portion from the feeding station and into severing engagement with the severing blade.

3. An apparatus for dispensing strip material or the like from a source of said material, the apparatus comprising a frame; a drive wheel mounted on the frame for substantially rotational movement; means borne by the frame for mounting a source of said strip material and having a pair of spaced substantially parallel guides mounted thereon, the guides of said pair spaced from each other a distance permitting a lead portion of said strip material to be supported on and extended between the guides with said guides on opposite sides of the drive wheel and with said lead portion of the strip material above the drive wheel; control means borne by the frame for placing the lead portion of the strip material in contact with the drive wheel; and means connected in driving relation to the drive wheel for selectively rotating the drive wheel to feed the lead portion of the strip material from the frame upon engagemcnt of the lead portion with said drive wheel.

4. The apparatus of claim 3 wherein said mounting means is a cartridge mounting said guides and movable to and from a loaded position, the strip material bears adhesive on a surface thereof engageable with said guides and the guides are of widths sufficient adhesively to retain the lead portion of the strip material thereon during movement to the loaded position and narrow enough to release the lead portion for feeding from the frame upon said rotating of the drive wheel while in engagement with the lead portion.

5. The apparatus of claim 4 wherein said control means includes means for movement into contact with the lead portion of the strip material and to carry said lead portion into adhesive contact with the drive wheel.

6. The apparatus of claim 5 wherein a severing blade is mounted on the frame and said control means includes a control frame mounted for movement on the frame between a driving position and a severing position and having a feed plate engageable with the lead portion of the strip material when the control frame is in the driving position to place said lead portion in adhesive contact with the drive wheel and a release plate movable with the control frame in said movement of the control frame to the severing position to carry said lead portion from adhesive contact with the drive wheel and into severing engagement with the severing blade.

7. An apparatus for dispensing adhesive tape from a source of said tape, the tpae dispensed by pulling on a leading end of the tape to dispense a lead portion of the length desired from a source, the apparatus comprising A. a housing;

B. a drive wheel mounted on the housing for substantially rotational movement adjacent to a feeding station;

C. means for driving the drive wheel in said substantially rotational movement;

D. means for supporting a source of said tape to be dispensed having a pair of substantially parallel guide members adapted individually adhesively to engage opposite sides of said lead portion of the tape to be dispensed and movable to carry said lead portion into the feeding station in overlaying relation to the drive wheel;

E. means mounted on the housing for severing the tape to be dispensed; and

F. a control mechanism mounted on the housing and selectively movable between a first position, engaging said lead portion and retaining it in engagement with the drive wheel to feed the lead portion in substantially continuous movement from a source of tape to be dispensed, and a second position to carry the lead portion from the drive wheel and into severing engagement with the severing means to dispense a lead portion of a selected length.

* * * * *